US008826488B2

(12) United States Patent
Varner

(10) Patent No.: US 8,826,488 B2
(45) Date of Patent: Sep. 9, 2014

(54) ASH FLUIDIZATION SYSTEM AND METHOD

(75) Inventor: Michael G. Varner, Knoxville, TN (US)

(73) Assignee: ALSTOM Technology Ltd, Baden (CH)

( * ) Notice: Subject to any disclaimer, the term of this patent is extended or adjusted under 35 U.S.C. 154(b) by 1110 days.

(21) Appl. No.: 11/494,946

(22) Filed: Jul. 28, 2006

(65) Prior Publication Data

US 2008/0022907 A1 Jan. 31, 2008

(51) Int. Cl.
*D06G 1/00* (2006.01)
*F23J 3/00* (2006.01)

(52) U.S. Cl.
CPC ..... *F23J 3/00* (2013.01); *F23J 2900/01001* (2013.01)
USPC ..... 15/316.1; 16/300.1; 16/318

(58) Field of Classification Search
USPC ..... 15/316.1, 300.1, 318
See application file for complete search history.

(56) References Cited

U.S. PATENT DOCUMENTS

| | | | | |
|---|---|---|---|---|
| 3,833,356 A | | 9/1974 | Luth | |
| 4,177,539 A | | 12/1979 | Elting | |
| 5,603,909 A | * | 2/1997 | Varner et al. | 423/239.1 |
| 5,618,499 A | * | 4/1997 | Lewis et al. | 422/177 |
| 5,661,872 A | * | 9/1997 | Meyer et al. | 15/309.2 |
| 5,778,831 A | * | 7/1998 | Jameel | 122/392 |
| 6,571,420 B1 | | 6/2003 | Healy et al. | |
| 7,500,437 B2 | * | 3/2009 | Lefebvre et al. | 110/186 |
| 7,624,470 B2 | * | 12/2009 | Heyman | 15/301 |

FOREIGN PATENT DOCUMENTS

| | | |
|---|---|---|
| CN | 2514232 | 10/2002 |
| DE | 198 24 204 | 12/1999 |
| DE | 19824204 | 12/1999 |
| FR | 649266 | 12/1928 |
| WO | WO 02/29317 | 4/2002 |

OTHER PUBLICATIONS

PCT International Search Report dated Feb. 15, 2008 (PCT/US2007/069601).
Written Opinion of the International Searching Authority dated Feb. 15, 2008—(PCT/US2007/069601).
Search Report established by the Intellectual Property Office of Singapore dated Mar. 18, 2013.

* cited by examiner

*Primary Examiner* — Lee D Wilson
*Assistant Examiner* — Shantese McDonald
(74) *Attorney, Agent, or Firm* — Rita D. Vacca

(57) ABSTRACT

A system for fluidizing ash in a duct of a selective catalytic reduction system. The system includes a duct, a source for generating compressed air, and an air injection header joined with the source and joined with the duct via one or more holes in the duct. The air injection header is adapted to inject compressed air from the source to the areas of the duct prone to dust build-up. The air injection header includes a sub-header joined with a plurality of injection lances. Each of the plurality of injection lances has an end nozzle. The end nozzle may have a mushroom cap or an angled end configuration to direct air in a particular direction.

14 Claims, 4 Drawing Sheets

ASH FLUIDIZATION SYSTEM AND METHOD

BACKGROUND OF THE INVENTION (1) Field of the Invention

The present invention generally relates to a system for preventing dust build-up in ductwork. More particularly, the present invention relates to a system that uses the injection of air to re-entrain or fluidize ash in flue gas flowing through the ductwork of a selective catalytic reduction (SCR) system.

(2) Description of the Related Art

Selective catalytic reduction (SCR) systems are commonly applied to utility and industrial combustion units to reduce NOx emissions. In an SCR system, ammonia or the like is injected into a flue gas. The flue gas injected with ammonia is passed through a catalyst where chemical reactions occur to convert NOx emissions to elemental nitrogen and water. The presence of a catalyst is generally required to accelerate the chemical reactions because SCR systems typically operate at relatively low temperatures, which may slow or prevent the chemical reactions. Commonly used catalysts include a vanadium/titanium formulation, zeolite materials, and the like.

Many of the installations place the SCR reactor in high dust locations before the particulate collection system. Careful attention is paid to the design of the ductwork and SCR reactor to avoid dust deposition. The catalyst is designed specifically to withstand the erosion and potentially poisonous effects of the fly ash. The ductwork velocities are chosen to ensure the fly ash remains entrained at the design point, because ash drop out in the ductwork is undesirable.

However, it is common for such systems to experience dust deposition in some locations within the ductwork under certain circumstances. The reduction in gas velocity through the ductwork experienced when the combustion unit is operated at reduced loads is the main cause of dust deposition. It could also be caused by environmental changes in the operating of the unit, for example, operating with lower excess air, or different fuels. The most common points for deposition are dead legs in the ductwork and in the ductwork just upstream of the SCR inlet hood.

FIGS. 1 and 2 provide an example of dust build-up and resulting plugging of a SCR system 20 from ash accumulation. FIG. 1 shows a portion of SCR system 20 when the combustion unit is operating at a low load 22. SCR system 20 is typically located between a steam generator outlet (not shown) and a pre-heater inlet (not shown). As a flue gas stream 21 flows through a duct 24, fly ash is typically present in the flue gas stream. A catalyst 26 is housed in SCR system 20 within duct 24 and is subjected to the full concentration of fly ash as the flue gas stream 21 passes through it. Catalyst 26 is typically covered by screens 28 to capture fly ash before it reaches the catalyst channels (not shown).

SCR system 20 is sized to receive flue gas stream 21 when the combustion unit (not shown) is operating at a full load. When the combustion unit (not shown) is operated at a low load 22, duct 24 has less flue gas passing through it. The velocity of flue gas stream 21 is therefore reduced greatly. This reduction in velocity can lead to dust deposition. As flue gas stream 21 flows through duct 24, a fly ash 30 accumulates and settles in a dust pile 32. Due to the design of duct 24, dust pile 32 normally occurs just upstream of an SCR inlet hood 34.

Referring now to FIG. 2, when SCR system 20 is operating at a full load 36, the velocity of flue gas stream 21 increases back to the design velocity. As the velocity is increased to accommodate full load 36, fly ash 30 that has accumulated in dust pile 32 may re-entrain suddenly causing an avalanche 38 of the fly ash to fall onto catalyst 26. As a result, channels (not shown) within catalyst 26 may become plugged and the efficiency of SCR system 20 reduced. The pressure drop across SCR system 20 may also increase.

Typically, the only measures taken to prevent the build-up of dust piles involve the design of the ductwork. Generally, the shape of the entrance to the SCR inlet hood can be designed such that the velocity through this transition piece is constant at the design point. The result is ductwork with a sloping roof that is at the same time, expanding to match the SCR reactor cross-section. Bypass ducts are protected either by equipping them with dampers to eliminate dead legs or by making the bypass duct have no shelf where ash can accumulate.

These approaches have generally been proven unsuccessful. The issue of dust deposition at the SCR inlet hood entrance and dead legs in the ductwork still remains. Ash piles being sloughed off onto the catalyst beds as the combustion unit comes back up to full output load is an issue. Current technology offers little to address the potential of ash deposition at the SCR reactor inlet area.

BRIEF SUMMARY OF THE INVENTION

One aspect of the invention is a system for fluidizing ash in a duct of a selective catalytic reduction system. The system includes a source for generating compressed air and an air injection header joined with the source and joined with the duct via one or more holes in the duct. The air injection header is adapted to inject compressed air from the source to the areas of the duct prone to dust build-up.

Another aspect of the invention is a system for fluidizing ash in a duct of a selective catalytic reduction system. The system includes a duct, a mechanism for generating compressed air, and an air injection header joined with the mechanism for generating compressed air and joined with the duct via one or more holes in the duct, The air injection header includes a sub-header joined with a plurality of injection lances. Each of the plurality of injection lances has an end nozzle. The air injection header is adapted to inject compressed air from the mechanism for generating compressed air to the areas of the duct prone to dust build-up.

Yet another aspect of the invention is a method for fluidizing ash in a duct of a selective catalytic reduction system. The method includes the following steps: providing a selective catalytic reduction system including a duct; generating compressed air; and injecting the compressed air to the areas of the duct prone to dust build-up via an air injection header and one or more holes in the duct.

Still another aspect of the invention is a selective catalytic reduction system including a duct, a catalyst positioned within the duct, and a mechanism for injecting compressed air into the duct at a position upstream of the catalyst.

BRIEF DESCRIPTION OF THE DRAWINGS

For the purpose of illustrating the invention, the drawings show a form of the invention that is presently preferred. However, it should be understood that the present invention is not limited to the precise arrangements and instrumentalities shown in the drawings, wherein.

DETAILED DESCRIPTION

Figure 3A:
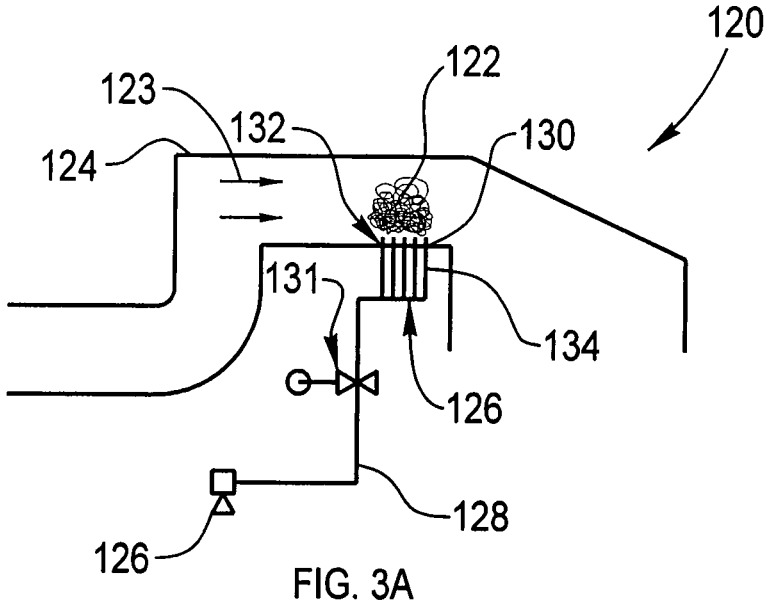
FIG. 3A is a section view of a system according to one embodiment of the present invention.
Figure 3B:
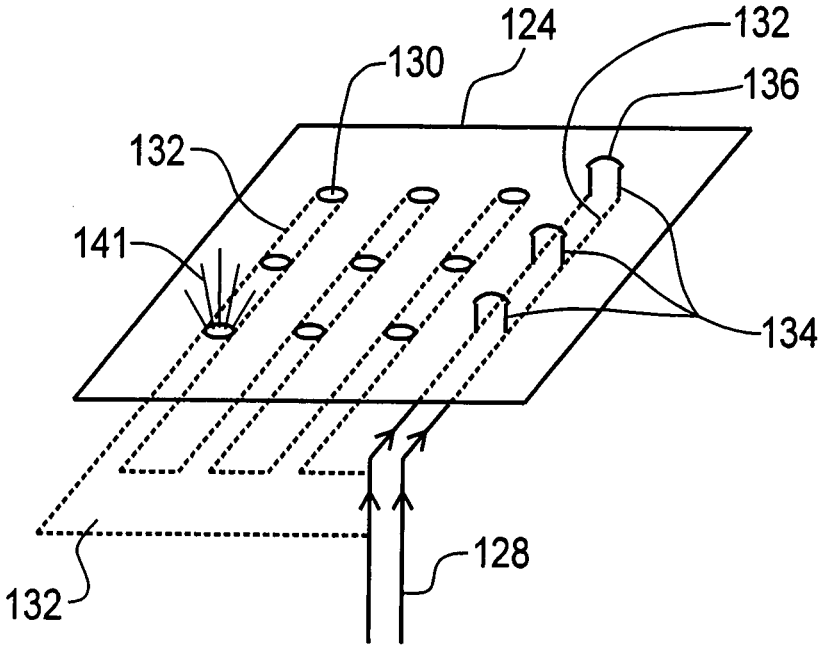
FIG. 3B is an isometric view of a sub-header according to one embodiment of the present invention.
Figure 4:
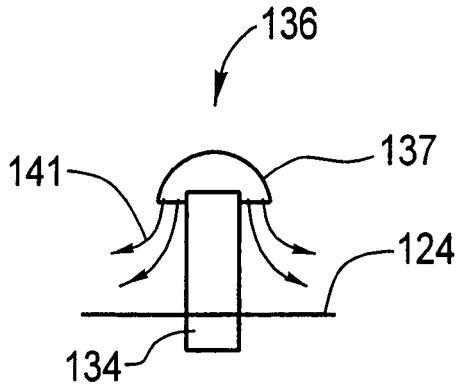
FIG. 4 is a section view of a nozzle according to one embodiment of the present invention.
Figure 5A:
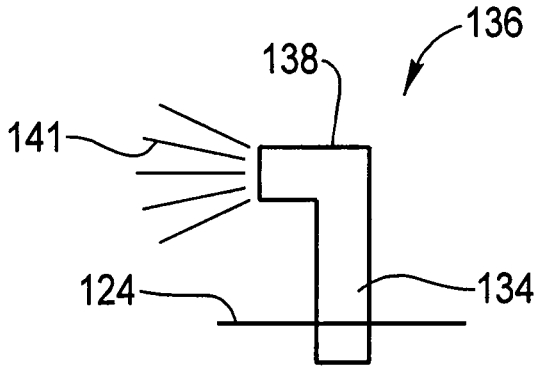
FIGS. 5A-5C are section views of a nozzle according to various embodiments of the present invention.
Figure 5B:
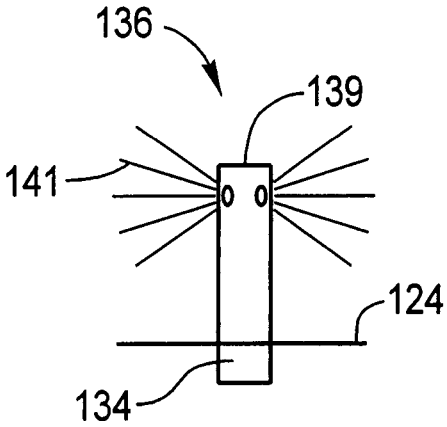
Figure 5C:
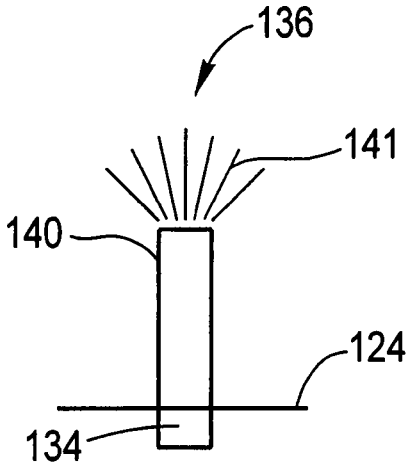

Referring now to the drawings in which like reference numerals indicate like parts, and in particular, to FIGS. 3A and 3B, one aspect of the present invention is a system 120 for fluidizing ash to prevent the formation of a pile 122 of a dust 123 in a duct 124 of a selective catalytic reduction system (SCR). In system 120, compressed air (not shown) from an air compressor 126 or a plant air supply (not shown) is injected to the areas of duct 124 prone to build-up of dust 123.

Figure 1:
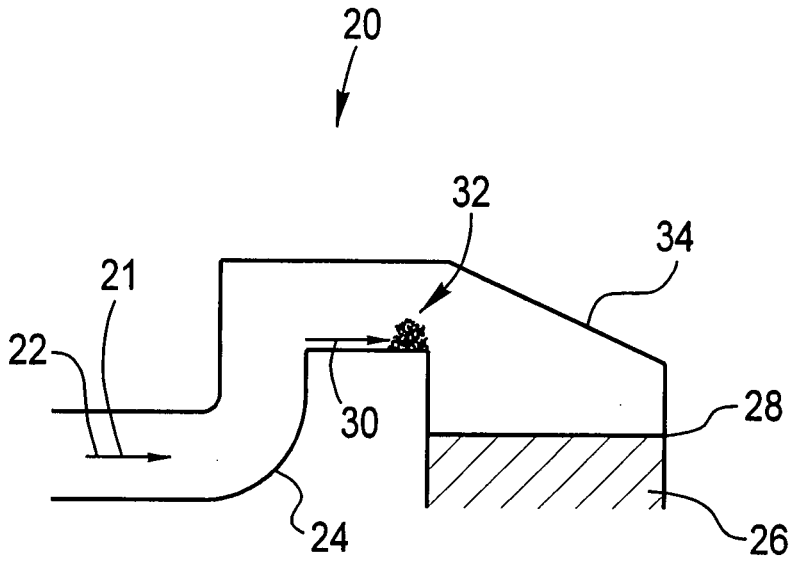
FIG. 1 (PRIOR ART)
FIG. 1 is a section view of a SCR system operating at a low load.
Figure 2:
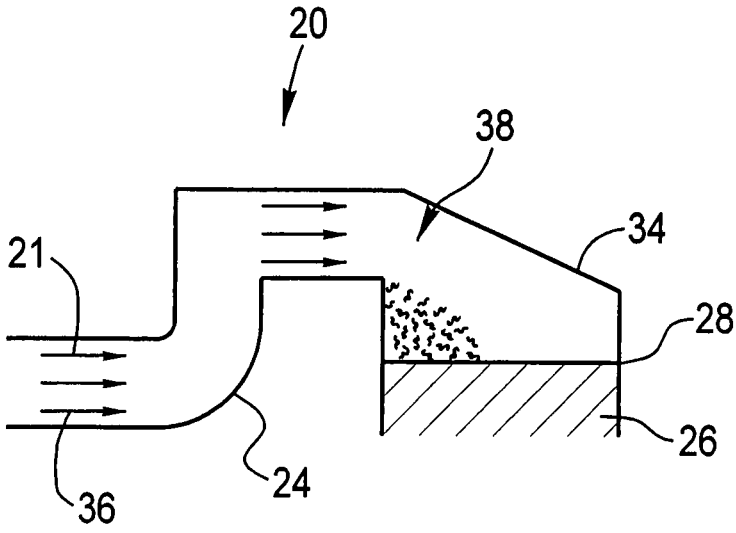
FIG. 2 (PRIOR ART)
FIG. 2 is a section view of a SCR system operating at a full load.

System 120 is typically located in an area of an SCR that is prone to build-up of dust 123, e.g., see FIGS. 1 and 2. An air injection header 128 is joined with duct 124 via one or more holes 130 in the duct. Air injection header 128 typically includes a control valve 131 for controlling the flow of air and isolating portions of system 120 for maintenance. Air injection header 128 typically includes a sub-header 132 joined with a plurality of injection lances 134. Each injection lance 134 generally includes an end nozzle 136.

Referring now to FIGS. 4 and 5A-5C, end nozzle 136 may have a mushroom cap 137, an angled end 138, a perforated end 139, or an open end 140 to direct compressed air 141 in a particular direction. Mushroom cap 137 is configured to direct compressed air 141 flowing upwardly through lance 134 downwardly to a surface of duct 124 (see arrows). Angled end 138 is configured to direct compressed air 141 flowing upwardly through lance 134 in a particular direction, e.g., laterally (see arrows). Perforated end 139 is configured to direct compressed air 141 flowing upwardly through lance 134 in a particular direction, e.g., laterally. Open end 140 is configured to direct compressed air 141 flowing upwardly through lance 134 in a particular direction, e.g., upwardly. Mushroom cap 137, angled end 138, perforated end 139, and open end 140 may be configured, e.g., include screens or appropriately sized opening, to help prevent dust 123 from entering lance 134. It is contemplated that each type of end nozzle 136 may be adjustable or movable in myriad directions, e.g., telescopically, rotationally, vertically, horizontally, laterally, axially, etc. Plurality of lances 134 within a single sub-header 132 may include any combination of different types of end nozzles 136. Alternatively, as illustrated in FIG. 3B, at least one of plurality of lances 134 may not include an end nozzle 136 and compressed air 141 may flow upwardly through the lance and through hole 130 in duct 124.

Figure 6:
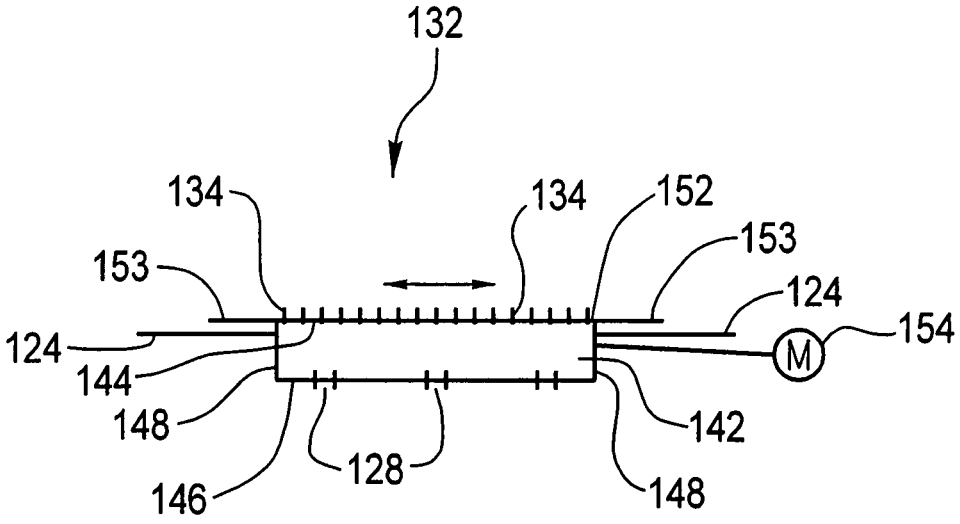
FIG. 6 is a section view of a manifold for use in an embodiment of the present invention.

Referring now to FIG. 6, in another embodiment, sub-header 132 includes a box-like manifold 142, which has a top 144, bottom 146, and sides 148 that form an interior cavity 150. Top 144 includes a top surface 152. Top surface 152 may includes an outside lip 153 that rests on duct 124 to ensure an airtight fit between sub-header 132 and the duct. A plurality of injection lances 134 extend upwardly through top surface 152 and inject compressed air from interior cavity 150, which is provided by air injection header 128, to the areas of duct 124 prone to build-up of dust 123. One or more of plurality of injection lances 134 may be fitted with an end nozzle 136. Optionally, a motorized, pneumatic cylinder, or other mechanism 154 is joined with manifold 142 and is configured to move the manifold back and forth laterally (see arrow) to facilitate the movement of dust 123 in duct 124. It is also contemplated that such a mechanism may be used to move the manifolds in FIGS. 3A and 3B.

In use, air from compressor 126 is sent to an air injection header 128. Air injection header 128 feeds sub-headers 132 that in turn, feed air into injection lances 134. Lances 134 extend into duct 124 through holes 130. The number of lances 134 may vary depending on the size of the SCR system. Each sub-header 128 typically feeds multiple injection lances 134. At the end of each injection lance 134 is typically a nozzle 136. Air exiting each nozzle 136 causes dust 123 in the area of nozzle 136 to fluidize and become re-entrained in the flue gas flowing through duct 124.

The use of a compressed air system to eliminate ash deposition in an SCR system offers advantages over prior art designs in that it eliminates dust avalanches from falling onto the catalyst and plugging it. The present invention has the advantage of compressed air being an inexpensive medium and readily available. Maintenance needs for air compressors are well known, easy to perform, and inexpensive. Additionally, because the nozzle design and header arrangement can be customized for plant specific requirements, aspects of the present invention may be easily modified.

Although the invention has been described and illustrated with respect to exemplary embodiments thereof, it should be understood by those skilled in the art that the foregoing and various other changes, omissions and additions may be made therein and thereto, without parting from the spirit and scope of the present invention. Accordingly, other embodiments are within the scope of the following claims.

What is claimed is:

1. A system for fluidizing ash in a duct of a selective catalytic reduction system, comprising:

a selective catalytic reduction system including a duct;

a source for generating compressed air; and a compressed air injection header joined with said source and joined with said duct via one or more holes in said duct upstream of a catalyst, wherein said compressed air injection header injects compressed air from said source to areas of said duct prone to dust build-up thereby re-entraining a dust in said duct in a flue gas flowing through said duct and the catalytic reduction system for removal of the dust from the duct via the flue gas.

2. A system according to claim 1, wherein said compressed air injection header further comprises a sub-header joined with a plurality of injection lances, each of said plurality of injection lances having an end nozzle.

3. A system according to claim 2, wherein said end nozzle includes one of a mushroom cap, an angled end configuration, a perforated end configuration, or an open end configuration.

4. A system according to claim 2, wherein said end nozzle is adjustable or movable.

5. A system according to claim 1, wherein said compressed air injection header further comprises a manifold including a top surface having a plurality of injection lances for directing a plurality of compressed air injections to the areas of the duct prone to dust build-up.

6. A system according to claim 5, further comprising a means for moving said manifold laterally to facilitate the movement of dust in said duct.

7. A system according to claim 6, wherein said means for moving includes a motor or pneumatic cylinder.

8. A system for fluidizing ash in a duct of a selective catalytic reduction system, comprising:

a duct;

means for generating compressed air; and a compressed air injection header joined with said means for generating compressed air and joined with said duct upstream of a catalyst via one or more holes in said duct, said compressed air injection header including a sub-header joined with a plurality of injection lances, each of said plurality of injection lances having an end nozzle, wherein said compressed air injection header injects compressed air from said means for generating compressed air to areas of said duct prone to dust build-up thereby re-entraining a dust in said duct in a flue gas flowing through said duct and the selective catalytic reduction system for removal of the dust from the duct via the flue gas.

9. A system according to claim 8, wherein said end nozzle includes one of a mushroom cap, an angled end configuration, a perforated end configuration, or an open end configuration.

10. A system according to claim 8, wherein said end nozzle is adjustable or movable.

11. A system according to claim 8, wherein said compressed air injection header further comprises a manifold including a top surface having a plurality of injection lances for directing a plurality of compressed air injections to the areas of said duct prone to dust build-up.

12. A system according to claim 11, further comprising a means for moving said manifold laterally to facilitate the movement of dust in said duct.

13. A system according to claim 12, wherein said means for moving includes a motor or pneumatic cylinder.

14. A method for fluidizing ash in a duct of a selective catalytic reduction system, comprising:

providing a selective catalytic reduction system including a duct;

generating compressed air; and re-entraining a dust in said duct in a flue gas flowing through said duct and selective catalytic reduction system by injecting said compressed air to areas of said duct prone to dust build-up via a compressed air injection header and one or more holes in said duct upstream of a catalyst for removal of the dust from the duct via the flue gas.

* * * * *